US010919130B2

(12) United States Patent
Berglund

(10) Patent No.: US 10,919,130 B2
(45) Date of Patent: Feb. 16, 2021

(54) WRENCH

(71) Applicant: Douglas L. Berglund, Minneapolis, MN (US)

(72) Inventor: Douglas L. Berglund, Minneapolis, MN (US)

( * ) Notice: Subject to any disclaimer, the term of this patent is extended or adjusted under 35 U.S.C. 154(b) by 0 days.

(21) Appl. No.: 15/107,847

(22) PCT Filed: Dec. 23, 2014

(86) PCT No.: PCT/US2014/072153

§ 371 (c)(1),
(2) Date: Jun. 23, 2016

(87) PCT Pub. No.: WO2015/100323

PCT Pub. Date: Jul. 2, 2015

(65) Prior Publication Data

US 2016/0318158 A1 Nov. 3, 2016

Related U.S. Application Data

(60) Provisional application No. 61/920,186, filed on Dec. 23, 2013.

(51) Int. Cl.

| | |
|---|---|
| ***B25B 7/02*** | (2006.01) |
| ***B25B 7/14*** | (2006.01) |
| ***B25B 7/22*** | (2006.01) |
| ***B25B 7/12*** | (2006.01) |
| ***B25B 7/08*** | (2006.01) |

(52) U.S. Cl.

CPC ..... *B25B 7/02* (2013.01); *B25B 7/08* (2013.01); *B25B 7/123* (2013.01); *B25B 7/14* (2013.01); *B25B 7/22* (2013.01)

(58) Field of Classification Search

CPC .. B25B 7/02; B25B 7/08; B25B 7/123; B25B 7/14; B25B 7/22

See application file for complete search history.

(56) References Cited

U.S. PATENT DOCUMENTS 184,403 A * 11/1876 Massey ..... F42B 33/12
717,526 A * 1/1903 Barney ..... B25B 27/205 81/302
1,613,929 A * 1/1927 Burckhalter ..... B25B 7/02 188/67

(Continued)

OTHER PUBLICATIONS

International Search Report for international application No. PCT/US2014/072153, dated Apr. 16, 2015 (2 pages).

*Primary Examiner* — Brian D Keller

(74) *Attorney, Agent, or Firm* — Hamre, Schumann, Mueller & Larson, P.C.

(57) ABSTRACT

The wrench includes a first member having a first jaw. The first jaw has at least one first nut member contacting edge. The wrench also has a second member having a second jaw. The second jaw has at least one second nut member contacting edge. The wrench further has a pivot axis at which the first and second members are pivotably coupled to each other, thereby allowing the first and second jaws to be movable between an open position and a closed position, and at least one opening defined by the at least one first nut member contacting edge and the at least one second nut member contacting edge, when the first and second jaws are positioned in the closed positions.

19 Claims, 16 Drawing Sheets

(56) References Cited

U.S. PATENT DOCUMENTS 1,678,313 A * 7/1928 Atkinson ..... H01M 2/1005 29/246
2,814,963 A * 12/1957 Harrington ..... B25B 7/02 294/118
2,842,997 A * 7/1958 Wentling ..... B25B 7/02 81/418
2,853,908 A * 9/1958 Logan ..... H01R 43/042 72/404
3,153,957 A 10/1964 Madeira
3,181,340 A * 5/1965 Gruetzmacher ..... A44B 11/24 72/409.01
4,198,738 A * 4/1980 Wallace ..... B25B 7/02 29/237
4,987,626 A * 1/1991 Montgomery ..... B25B 7/10 7/127
5,074,175 A * 12/1991 Earle ..... B25B 25/00 81/302
5,531,141 A * 7/1996 Gilbert, Jr. ..... B25B 7/02 81/424.5
5,537,727 A * 7/1996 Mayer ..... B25B 27/10 29/237
5,582,084 A * 12/1996 Sarmiento ..... B25B 7/00 294/118
6,336,386 B1 * 1/2002 Lee ..... B25B 7/14 269/6
D544,770 S * 6/2007 Yang ..... D8/52
7,779,733 B1 * 8/2010 Dumback ..... B25B 7/02 29/426.1
8,015,853 B2 * 9/2011 Steiner ..... B21D 39/048 72/409.01
8,056,451 B2 * 11/2011 Chervenak ..... B25B 7/10 81/318
8,381,622 B2 * 2/2013 Roppolo ..... B25B 7/02 81/318
8,397,608 B1 * 3/2013 Dumback ..... B25B 7/02 81/418
9,272,394 B2 * 3/2016 Buchanan ..... B25B 7/14
9,566,691 B2 * 2/2017 Ford ..... B25B 7/04
9,744,653 B2 * 8/2017 Vaale ..... B25B 7/123
2003/0172782 A1 * 9/2003 Saunders ..... B25B 13/28 81/119
2003/0233915 A1 * 12/2003 Takasaki ..... B25B 7/02 81/424.5
2008/0110303 A1 5/2008 McCabe
2008/0276767 A1 11/2008 Huang

* cited by examiner

WRENCH

FIELD

This disclosure relates generally to a hand tool, and more particularly, but not by way of limitation, to a wrench that can be used to tighten or loosen joints.

BACKGROUND

Wrenches are typically used for tightening or loosening nut-bolt joints because finger-hand strength is often insufficient. Wing nuts have been employed to provide convenient mechanical advantages by providing additional leverage to allow fingers to purchase on the wings. In such circumstances, a user might tighten or loosen wing nuts without utilizing a tool. However, when multiple wing nuts need to be securely and quickly tightened or loosened, and the tightening or loosening action needs to be performed repetitively, it is difficult to do so by mere finger-hand strength without over tensioning. In fact, fingers alone are often insufficient to completely and securely tighten a nut, and they are especially inadequate to loosen a securely tightened nut.

SUMMARY

Some embodiments of a wrench for tightening or loosening a nut can be configured to have a first member having a first jaw and a first holding arm, and a second member having a second jaw and a second holding arm. The first and second members are articulated to one another by a joint. In such circumstances, the wrench can be configured to allow the user to grasp the holding arms to cause the jaws to clamp over the nut, and thereby allow the user to rotate the wrench which in turn rotates the nut for tightening or loosening. This configuration allows the nut to be accessed even in obscure angle settings, and thus allows the nut to be tightened or loosened more easily, quickly and securely. Moreover, the wrench forms an axial extension of the nuts, and as a result, the user can operate the wrench at an axially distant location. Further, the wrench disclosed herein requires a small radial space for tightening or loosening the nut. For example, when it is used to tighten or loosen a wing nut, the wrench can require a space having a radius that is substantially as small as a radius of the wing nut. The wrench can be used for tightening or loosening various sizes and types of nuts, such as butterfly nuts, castle nuts, shank nuts, cap nuts, spring nut, or the like. It is to be understood that the wrench not only can be used for tightening or loosening nuts but also can be used in other applications, such as tightening a bolt, etc.

Particular embodiments include a wrench. The wrench includes a first member having a first jaw. The first jaw has at least one first nut member contacting wall. The wrench also has a second member having a second jaw. The second jaw has at least one second nut member contacting wall. The wrench further has a pivot axis at which the first and second members are pivotably coupled to each other, thereby allowing the first and second jaws to be movable between an open position and a closed position, and at least one opening defined by the at least one first nut member contacting wall and the at least one second nut member contacting wall, when the first and second jaws are positioned in the closed positions. The at least one opening has a central axis extending through a geometric center of the at least one opening and perpendicular to a plane in which the at least one opening lies. The first and second jaws move away from the central axis when the first and second jaws are moving toward the open position, and the first and second jaws move toward the central axis when the first and second jaws are moving toward the closed position.

In some embodiments, a method of making the wrench may include fabricating first and second nut member contacting walls so that the first and second nut member contacting walls correspond to each other and define an opening.

Other embodiments may include a method of using the wrench. The method includes approaching a nut from a central axis direction of an opening; clamping the nut by first and second jaws; and rotating the nut to tighten or loosen the nut.

These and other embodiments described herein may provide one or more of the following benefits. First, some embodiments of the wrench can be configured to allow the user to grasp the holding arms to cause the jaws to clamp over the nut, and thereby allow the user to rotate the nut for tightening or loosening. This configuration allows the nut to be accessed even in obscure angle settings, and thus allows the nut to be tightened or loosened more easily, quickly and securely. Second, the wrench forms an axial extension of the nuts, and as a result, the user can operate the wrench at an axially distant location. Third, the wrench disclosed herein requires a small radial space for tightening or loosening the nut. For example, when it is used to tighten or loosen a wing nut, the wrench can require a space having a radius that is substantially as small as a radius of the wing nut. Fourth, the wrench can be used for tightening or loosening various sizes and various types of nuts, such as butterfly nuts, castle nuts, shank nuts, cap nuts, spring nut, or the like. As a result, the wrench allows maximum leveraged and secured tightness to be achieved with much less effort and little to no damage to the nut, not to mention pain to the user's hands, during a tightening or loosening procedure.

The details of one or more embodiments of the invention are set forth in the accompanying drawings and the description below. Other features, objects, and advantages of the invention will be apparent from the description and drawings, and from the claims.

DESCRIPTION OF THE DRAWINGS

FIG. 6 is shows a surface of a first jaw, viewed in the direction of the arrow VI in

FIG. 4.

Like reference symbols in the various drawings indicate like elements.

DETAILED DESCRIPTION

Some embodiments of a wrench for tightening or loosening a nut can be configured to have a first member having a first jaw and a first holding arm, and a second member having a second jaw and a second holding arm. The first and second members are articulated to one another by a joint. In such circumstances, the wrench can be configured to allow the user to grasp the holding arms to cause the jaws to clamp over the nut, and thereby allow the user to rotate the wrench which in turn rotates the nut for tightening or loosening. This configuration allows the nut to be accessed even in obscure angle settings, and thus allows the nut to be tightened or loosened more easily, quickly and securely. Moreover, the wrench forms an axial extension of the nuts, and as a result, the user can operate the wrench at an axially distant location. Further, the wrench disclosed herein requires a small radial space for tightening or loosening the nut. For example, when it is used to tighten or loosen a wing nut, the wrench can require a space having a radius that is substantially as small as a radius of the wing nut. The wrench can be used for tightening or loosening various sizes and types of nuts, such as butterfly nuts, castle nuts, shank nuts, cap nuts, spring nut, or the like. It is to be understood that the wrench not only can be used for tightening or loosening nuts but also can be used in other applications, such as tightening a bolt, etc.

For convenience of explanation, the wrench is to be described as a wrench for tightening or loosening a wing nut. However, it is to be understood that the wrench can be used for tightening or loosening various sizes and types of nuts, such as butterfly nuts, castle nuts, shank nuts, cap nuts, spring nut, or the like. It is also to be understood that the wrench not only can be used for tightening or loosening nuts but also can be used in other applications, such as tightening a bolt, etc.

The terms "above," "on," "under," "top," "bottom," "up," "down," "upper," "lower," "horizontal," "vertical," "front," "rear," "left," "right" and the like used herein are in reference to the relative positions of the wrench and its constituent parts, as oriented in the specific figures being described. These terms are not meant to be limiting in any way.

Figure 1:
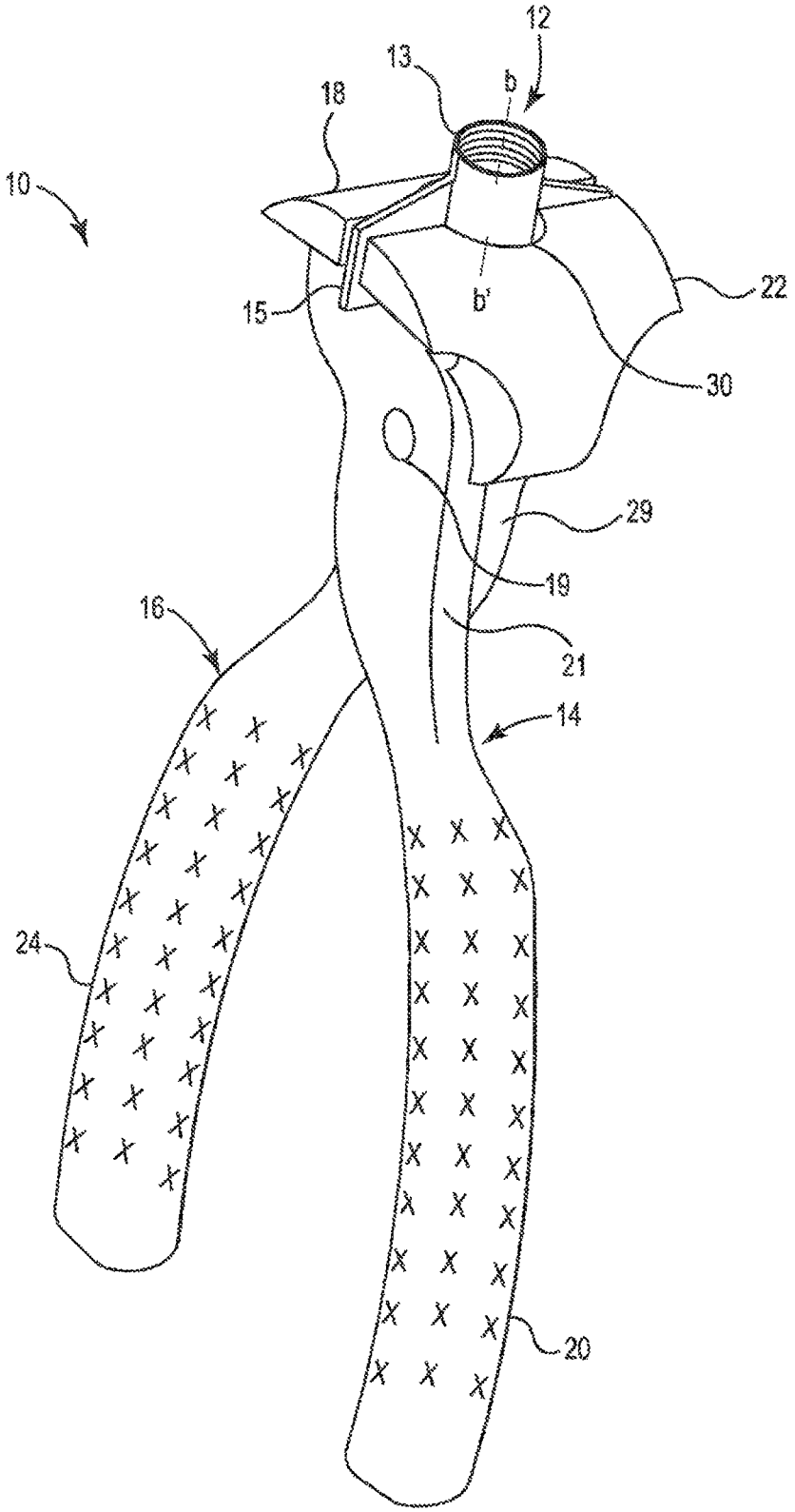
FIG. 1 is a perspective view of an embodiment of a wrench with a nut clamped between its jaws.
Figure 2:
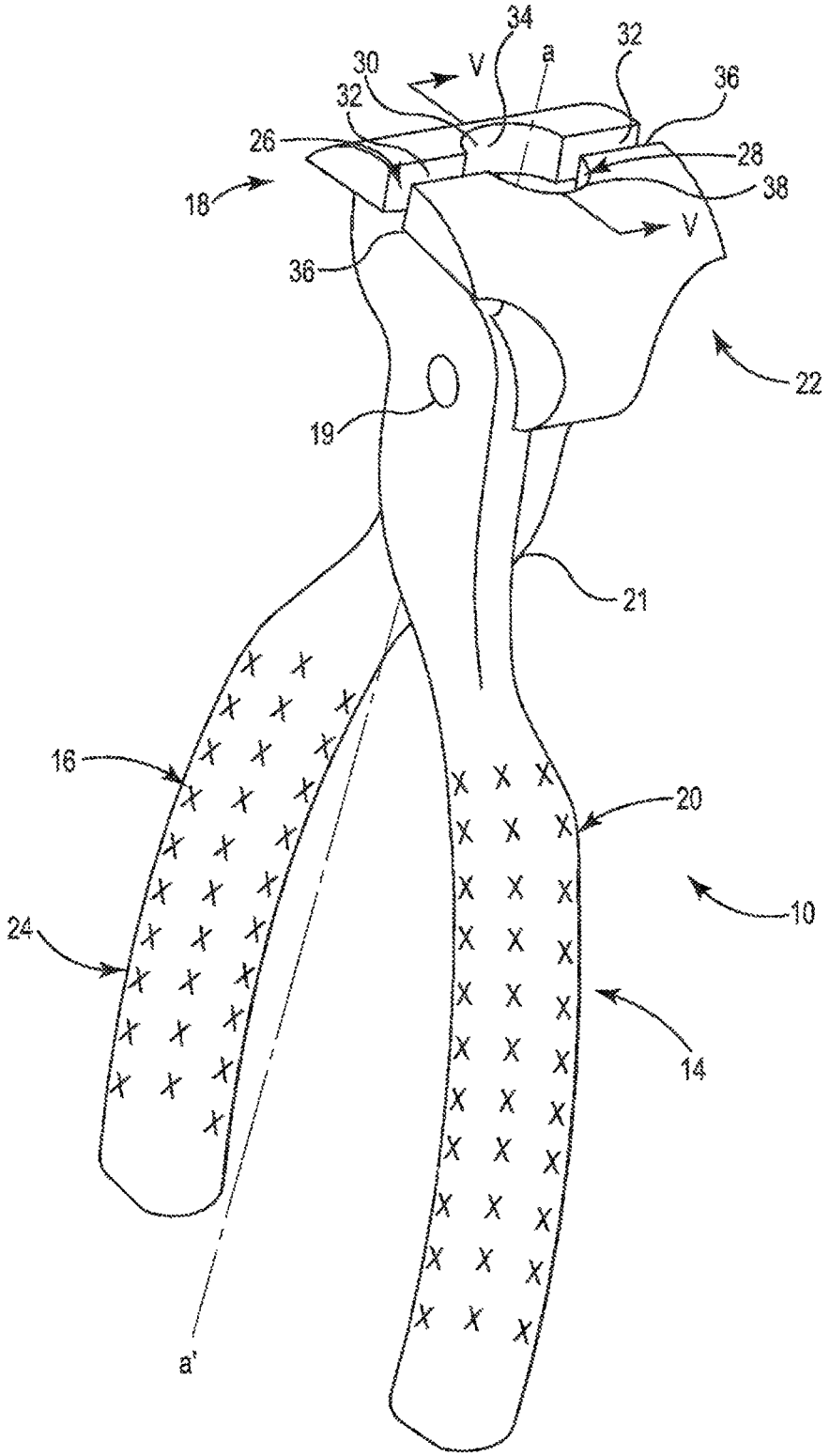
FIG. 2 is a perspective view of the wrench of FIG. 1.

FIGS. 1 and 2 illustrate details of a wrench 10 for tightening or loosening a nut 12. The nut 12 includes a nut member 13 located at a center of the nut and a pair of radially extending wings 15. However, it is to be understood that the nut can be any types of nuts and is not limited to wing nut. Also, the nut member 13 is not necessarily located at a center location of the nut.

The wrench 10 has a first member 14 and a second member 16. The first and second members 14, 16 are articulated to one another via a coupling member at a pivot axis 19. The first member 14 has a first jaw 18, a first holding arm 20 and a first joint portion 21. The second member 16 has a second jaw 22, a second holding arm 24 and a second joint portion 29.

Referring to FIGS. 1-4, the first and second holding arms 20, 24 can be constructed to have a curved configuration for easy grasping in the palm of the user's hand. However, other shapes can be used for the first and second holding arms 20, 24. As can be seen from FIGS. 1 and 2, the first holding arm 20 is connected to the first jaw 18 by the first joint portion 21, and the second holding arm 24 is connected to the second jaw 22 by the second joint portion 29. The pivot axis 19 is arranged between the ends of the first member 14 and second member 16. The first and second members 14, 16 are shaped and disposed so as to be pivotable at the pivot axis 19 by a fastener.

Figure 3:
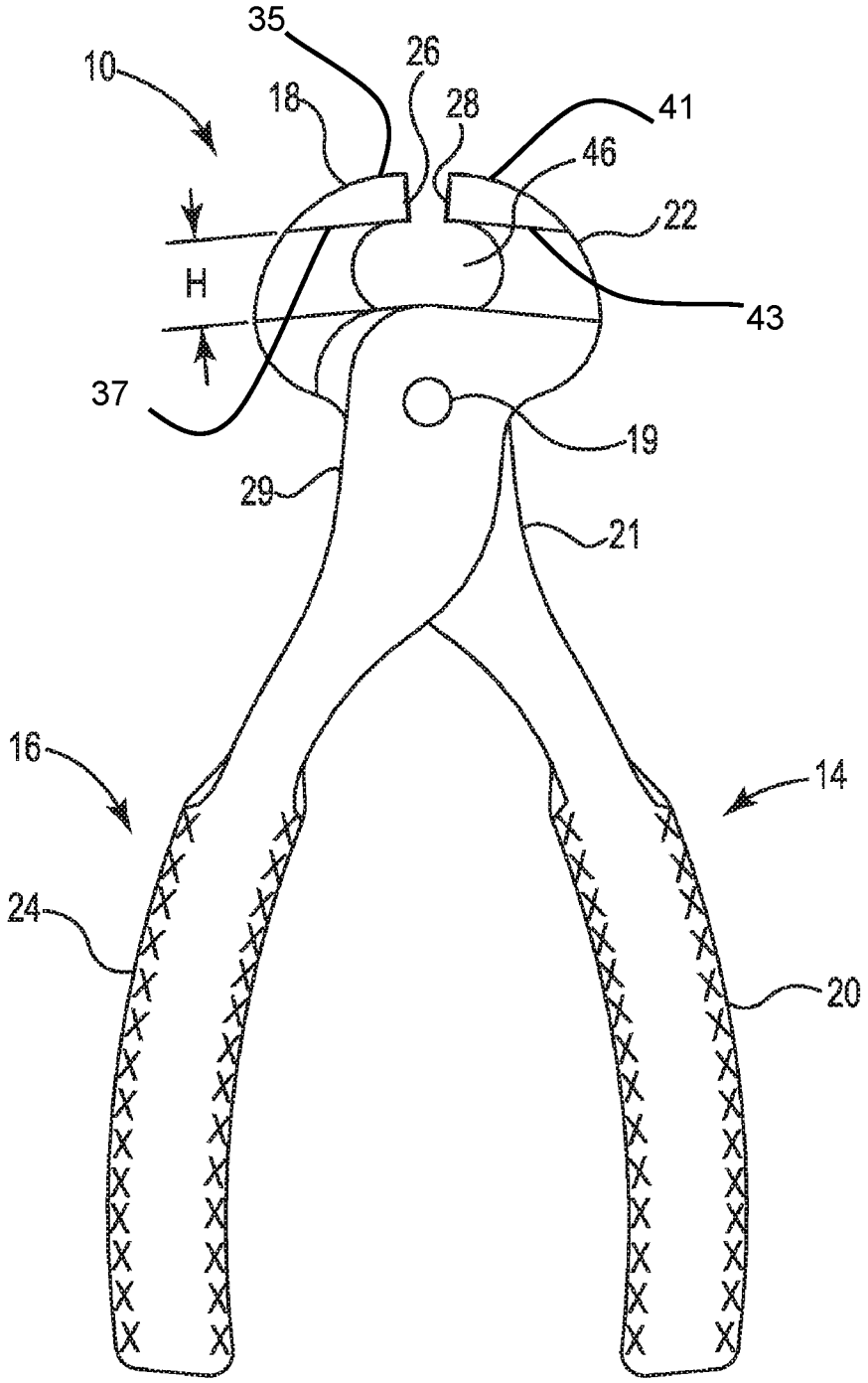
FIG. 3 is a side view of the wrench of FIG. 1.

Referring to FIG. 3, the wrench 10 further includes a space 46 formed between the jaws 18, 22, and the joint portions 21, 29. The space 46 has a height H. The height H can be configured to be great enough to allow a free end of a bolt locked by the nut to extend into the space 46. When a portion of a bolt extends out of the nut 12, the space 46 receives the portion of the bolt, thereby allowing the nut 12 to be clamped between the first and second jaws 18, 22.

Figure 4:
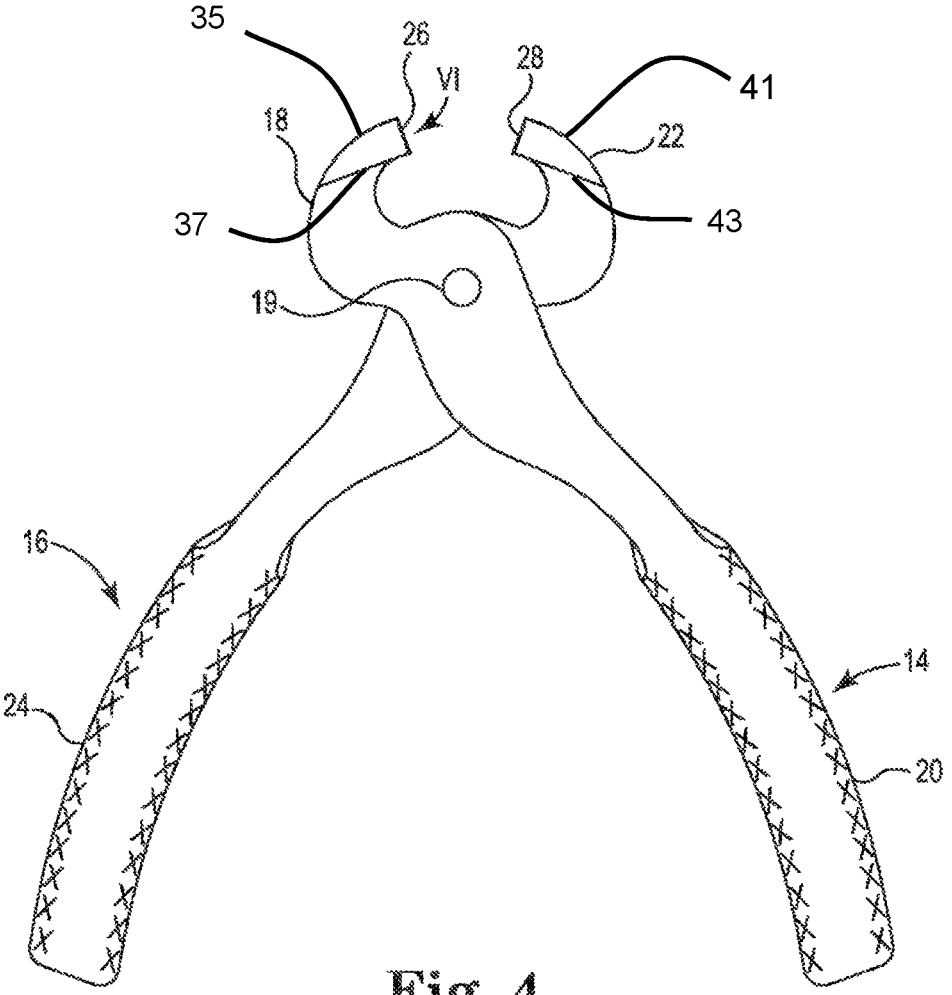
FIG. 4 is a further side view of the wrench of FIG. 1, with two pliers parts spreading largely in a V-shape, and holding arms disposed apart from one another.

Referring to FIGS. 3-4, when closing the wrench 10, forces are exerted onto the first and second holding arms 20, 24 so that the first and second holding arms 20, 24 move toward each other. The first and second members 14, 16 are configured to be rotatable about the pivot axis 19. The relative movement towards one another by the first and second holding arms 20, 24 leads to closing the first and second jaws 18. 22.

As shown in FIG. 4, the portions of the first and second members 14, 16 located upward of the pivot axis 19 form the first and second jaws 18, 22, respectively. The first and second jaws 18, 22 are configured to rotate toward one another as the first and second holding arms 20, 24 are clamped together. The first and second jaws 18, 22 are shaped to provide a first gripping surface 26 and a second gripping surface 28, respectively. In the embodiment depicted in FIGS. 1 and 2, the first gripping surface 26 can include a first nut member contacting wall 34 in a middle section and first left and right parallel walls 32 on both sides of the first nut member contacting wall 34. A first edge 341 is defined between a top surface 181 of the first jaw 18 and the first nut member contacting wall 34. The second gripping surface 28 can include a second nut member contacting wall 38 in a middle section and second left and right parallel walls 36 on both sides of the second nut member contacting wall 38. A second edge 381 is defined between a top surface 221 of the second jaw 22 and the second nut member contacting wall 38.

In some embodiments, the first left and right parallel walls 32 and the second left and right parallel walls 36 are positioned generally parallel to each other when the first and second jaws 18, 22 are brought into the closed position.

The size and shape of the first and second parallel walls 32, 36 and the first and second nut member contacting walls 34, 38 are configured to allow a nut of various sizes and shapes to be clamped between the first and second jaws 18, 22. Generally, the greater the contact area between the nut 12 and the gripping surfaces 26, 28, the firmer the grip will be on the nut 12.

Referring to FIGS. 3-4, in the embodiment depicted, the first jaw 18 has a first upper surface 35, a first lower surface 37, a first nut member contacting wall 34 extending from the first upper surface 35 to the first lower surface 37. The first upper surface 35 is positioned farther away from the first joint portion 21 than the first lower surface 37. The second jaw 22 has a second upper surface 41, a second lower surface 43, a second nut member contacting wall 38 extending from the second upper surface 41 to the second lower surface 43. The second upper surface 41 is positioned farther away from the second holding arm 24 than the second lower surface 43.

Figure 5:
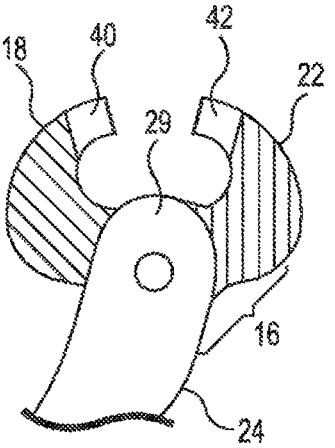
FIG. 5 is a partial sectional view taken along line V-V in FIG. 2.
Figure 7C:
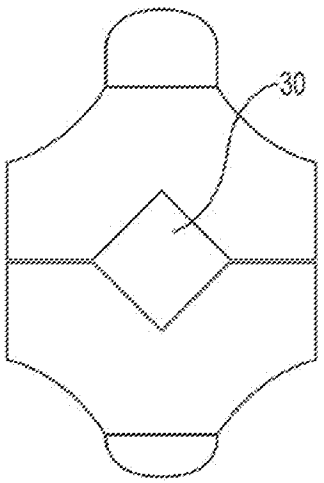
FIGS. 7A-F show various shapes of the opening defined by first and second jaws when the jaws are in a closed position.
Figure 7B:
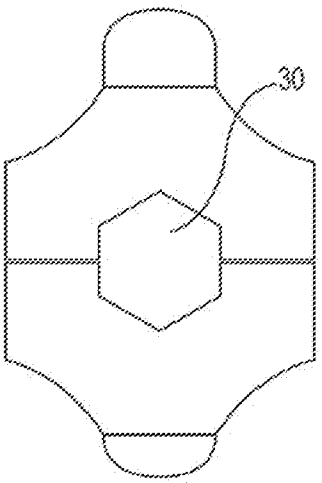
Figure 7A:
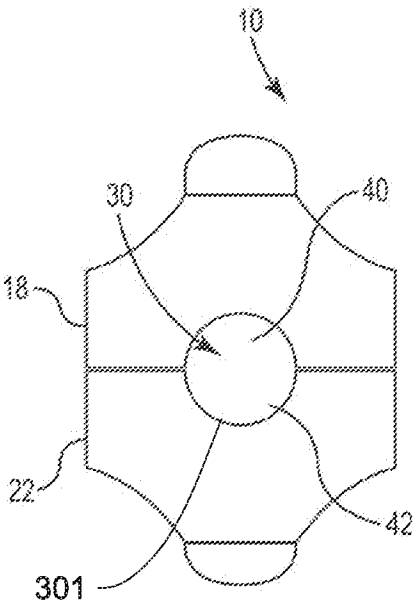

FIG. 5 is a partial sectional view of the wrench 10, running along the line V-V shown in FIG. 2. The first nut member contacting wall 34 defines a first recess 40, and the second nut member contacting wall 38 defines a second recess 42. The first and second recesses 40, 42 can be paired to form an opening 30 (referring to FIG. 7A) to receive the nut member 13 of the nut 12 when the first and second jaws 18, 22 are closed. The at least one opening 30 has a top edge 301 that comprises the first edge 341 and the second edge 381.

The first and second members 14, 16 can be produced from metal. In some embodiments, the first and second members 14, 16 can be produced by metal injection molding (MIM), also known as metal powder injection molding. In some embodiments, the first and second holding arms 20, 24 can be covered by a material that provides a particularly good grip in order to prevent slipping when handling the wrench 10. The material must be hard enough to absorb forces that occur when the wrench is used and to be able to conduct those forces to first and second jaws 18, 22.

Figure 6:
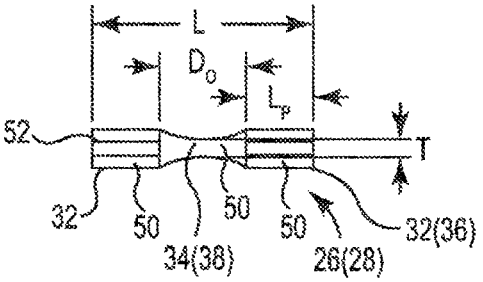

Referring to FIG. 6, each of the first left and right parallel walls 32 and second left and right parallel walls 36 are generally rectangular in shape, each wall 32, 36 having a length $L_P$ and a thickness T. In the embodiment depicted in FIG. 6, the entire length of the first or second gripping surface 26, 28 is L. In some embodiments, the entire length L of the first or second gripping surfaces 26, 28 ranges from ⅙ inch to 3 inches. It is to be understood that the size of the wrench 10 can vary depending on the size of the nut to be tightened or loosened. In some embodiments, the wrench 10 is used to clamp over a nut that has a grip of 1/10 inch or greater. In a particular embodiment, the entire length L of the first or second gripping surface 26, 28 is 1½ inch.

The thickness T of the first or second nut member contacting wall 34, 38 ranges between 0 and 2 inches. In another embodiment, the thickness T of the first or second nut member contacting wall 34, 38 ranges between ¼ inches and 2 inches. In a further embodiment, the thickness T of the first or second nut member contacting wall 34, 38 is about ¼ inches.

The thickness of the first or second left and right parallel walls 32, 36 ranges between 0 and 2 inches. In another embodiment, the thickness of the first or second left and right parallel walls 32, 36 ranges between ¼ inches and 2 inches. In a further embodiment, the thickness of the first or second left and right parallel walls 32, 36 is about ¼ inches.

In some embodiments, the wrench 10 can be configured to tighten or loosen a nut that has a diameter $D_O$ ranging from 1/10 inch to 3 inches.

Still referring to FIG. 6, in some embodiments, at least one of the gripping surfaces 26, 28 respectively formed on the first and second jaws 18, 22 has a gripping enhancing feature 50 for enhancing the grip on the nut 12 during operation. In some embodiments, the gripping enhancing feature 50 can be an elastomeric, for example, silicone, deformable element disposed on at least one of the gripping surface 26, 28 respectively formed on the jaws 18, 22.

The gripping enhancing feature 50 is soft and pliable so that it can receive and clamp a full range of the side surface of the nut 12 reliably. In some embodiments, the gripping enhancing feature 50 is disposed over the entire area of the gripping surface 26 or 28 so that it can grip virtually any portion of the height of the nut 12. This allows a firm grip on the nut 12 even if the graspable portion of the nut 12 has a height that is smaller than the thickness T of the jaws 18, 22. In further embodiments, the gripping enhancing feature 50 includes surface textures 52 such as roughening, grooving, dimpling, hatching, etc. to further enhance a user's grip on the nut.

In the embodiment as depicted in FIG. 6, the surface textures 52 include three parallel grooves formed on both the first left and right parallel walls 32, and/or second left and right parallel walls 36. In other embodiments, the gripping enhancing feature 50 further includes surface textures 52 formed on the first nut member contacting wall 34 or the second nut member contacting wall 38.

Referring to FIGS. 7A-F, in some embodiments, the opening 30 can have circular shapes (referring to FIGS. 1-6 and 7A), hexagonal shapes (referring to FIG. 7B), diamond shapes (referring to FIG. 7C), 12-point shapes (referring to FIG. 7D), oval shapes (referring to FIG. 7E-F), or other shapes of openings, such as 6-point shapes. The 12-point configuration allows the wrench to be used to securely tighten or loosen a nut without wings. It is to be understood that the opening can be in other shapes as long as it is large enough to accommodate at least a portion of the nut member 13 of the nut 12.

In some embodiments, the opening 30 is configured to snuggly receive the nut member 13 of the nut 12. This helps avoid applying excessive pressure on the nut member 13, and thereby reduces the change of stripping the nut 12, and avoid damage to or destruction of the nut 12.

In some embodiments, especially when the nut 12 does not have wings 15, the opening 30 can be sized and shaped such that it generally tracks the size and shape of the outer contour of the nut member 13 of the nut 12 to assure a firm grip on the nut 12.

Figure 7F:
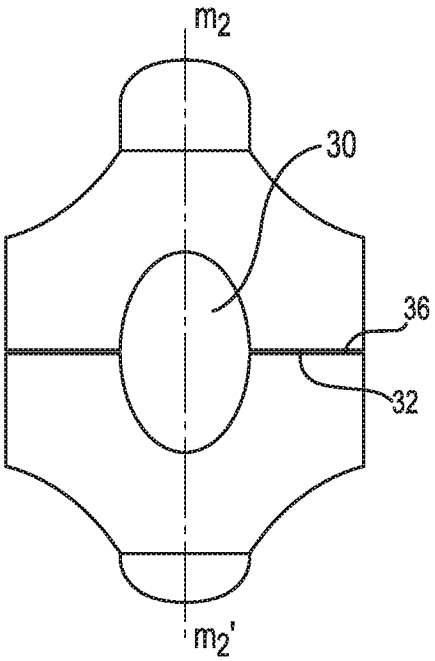
Figure 7E:
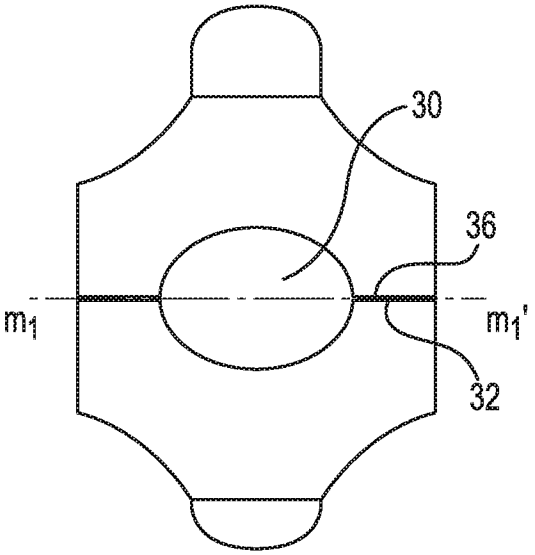
Figure 7D:
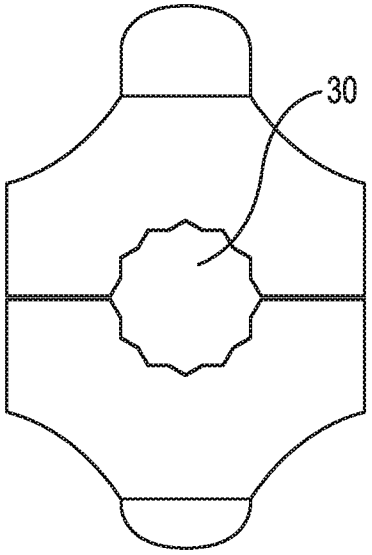

Referring to FIGS. 7E-F, the oval shape in this figure is a generally mathematical elliptical with its left half portion generally identical to its right half portion and with the first and second nut member contacting walls 34, 38 generally identical to each other. The embodiment depicted in FIG. 7E has a parallel elliptical opening, in which a major axis $m_1$-$m_1'$ of the ellipse is positioned parallel to the first and second left and right parallel walls 32, 36, thereby allowing the wrench to be used to tighten or loosen multiple sizes of wing-nuts. The embodiment depicted in FIG. 7F has a perpendicular elliptical, in which the major axis $m_2$-$m_2'$ of the ellipse is positioned generally perpendicular to the first and second left and right parallel walls 32, 36.

Figure 7I:
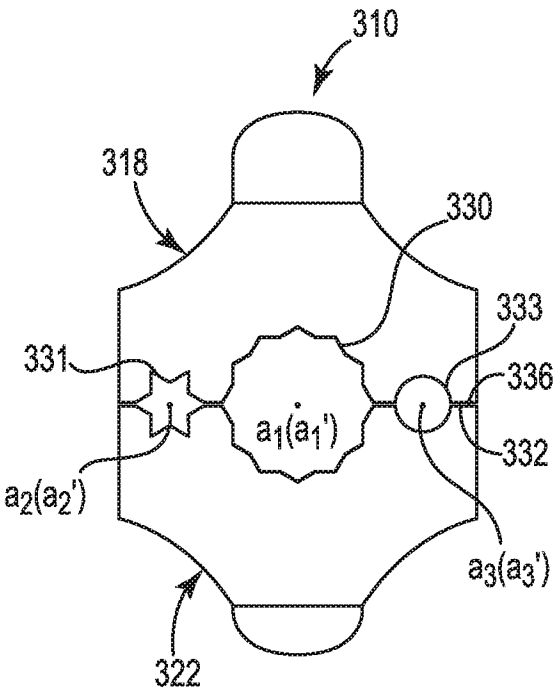
FIGS. 7G-I show multiple openings defined by the first and second jaws when the jaws are in a closed position.
Figure 7H:
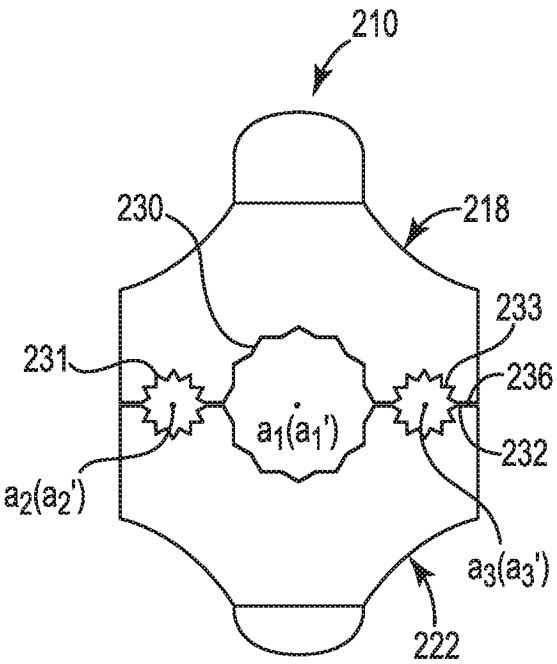
Figure 7G:
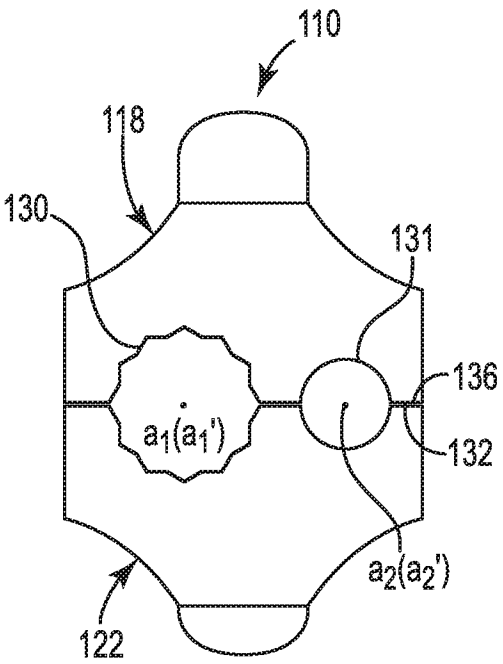

Referring to FIGS. 7G-I, in some embodiments, the first and second jaws define a plurality of openings. In the embodiment depicted in FIG. 7G, the wrench has a first jaw 118 and a second jaw 122. Two openings 130, 131 are defined by the first and second jaws 118, 122, and the opening 130 is larger than the opening 131. The two openings 130, 131 can have circular shapes, hexagonal shapes, diamond shapes, 12-point shapes, 6-point shapes, oval shapes, parallel elliptical shapes with a major axis generally parallel to first and second parallel walls 132, 136, perpendicular elliptical shapes with a major axis generally perpendicular to the first and second parallel walls 132, 136, other shapes of openings, or combinations thereof. In the embodiment depicted in FIG. 7G, the opening 130 has a central axis $a_1$-$a_1'$, and the opening 131 has a central axis $a_2$-$a_2'$, where the axes $a_1$-$a_1'$ and $a_2$-$a_2'$ are parallel to each other and lie in a same plane.

In the embodiment depicted in FIG. 7H, the wrench has a first jaw 218 and a second jaw 222. Three openings 230, 231, 233 are defined by the first and second jaws 218, 222. The opening 230 located in the middle is larger and the openings 231, 233 located on the left and right sides of the opening 230 are smaller. In the embodiment depicted in FIG. 7H, the sizes of the openings 231, 233 are generally identical to each other. However, it is to be understood, one of these two openings can be larger than the other. Also, the openings 231 or 233 on the left and right sides of the opening 230 can be larger than the opening 230.

The three openings 230, 231, 233 can have circular shapes, hexagonal shapes, diamond shapes, 12-point shapes, 6-point shapes, oval shapes, parallel elliptical shapes with a major axis generally parallel to first and second parallel walls 232, 236, perpendicular elliptical shapes with a major axis generally perpendicular to the first and second parallel walls 232, 236, other shapes of openings, or combinations thereof. In the embodiment depicted in FIG. 7H, the openings 231 and 233 have a same shape. The opening 230 has a central axis $a_1$-$a_1$', the opening 231 has a central axis $a_2$-$a_2$', and the opening 233 has a central axis $a_3$-$a_3$' where the axes $a_1$-$a_1$', $a_2$-$a_2$' and $a_3$-$a_3$' are parallel to each other and lie in a same plane.

In the embodiment depicted in FIG. 7I, the wrench has a first jaw 318 and a second jaw 322. Three openings 330, 331, 333 are defined by the first and second jaws 318, 322. The opening 330 located in the middle is larger and the openings 331, 333 located on the left and right sides of the opening 330 are smaller. In the embodiment depicted in FIG. 7I, the sizes of the openings 331, 333 are generally identical to each other. However, it is to be understood, one of these two openings can be larger than the other. Also, the openings 331 or 333 on the left and right sides of the opening 330 can be larger than the opening 330.

The three openings 330, 331, 333 can have circular shapes, hexagonal shapes, diamond shapes, 12-point shapes, 6-point shapes (referring to the opening 331), oval shapes, parallel elliptical shapes with a major axis generally parallel to first and second parallel walls 332, 336, perpendicular elliptical shapes with a major axis generally perpendicular to the first and second parallel walls 332, 336, other shapes of openings, or combinations thereof. In the embodiment depicted in FIG. 7I, the openings 331 and 333 have different shapes. The opening 330 has a central axis $a_1$-$a_1$', the opening 331 has a central axis $a_2$-$a_2$', and the opening 333 has a central axis $a_3$-$a_3$' where the axes $a_1$-$a_1$', $a_2$-$a_2$' and $a_3$-$a_3$' are parallel to each other and lie in a same plane.

Figure 8:
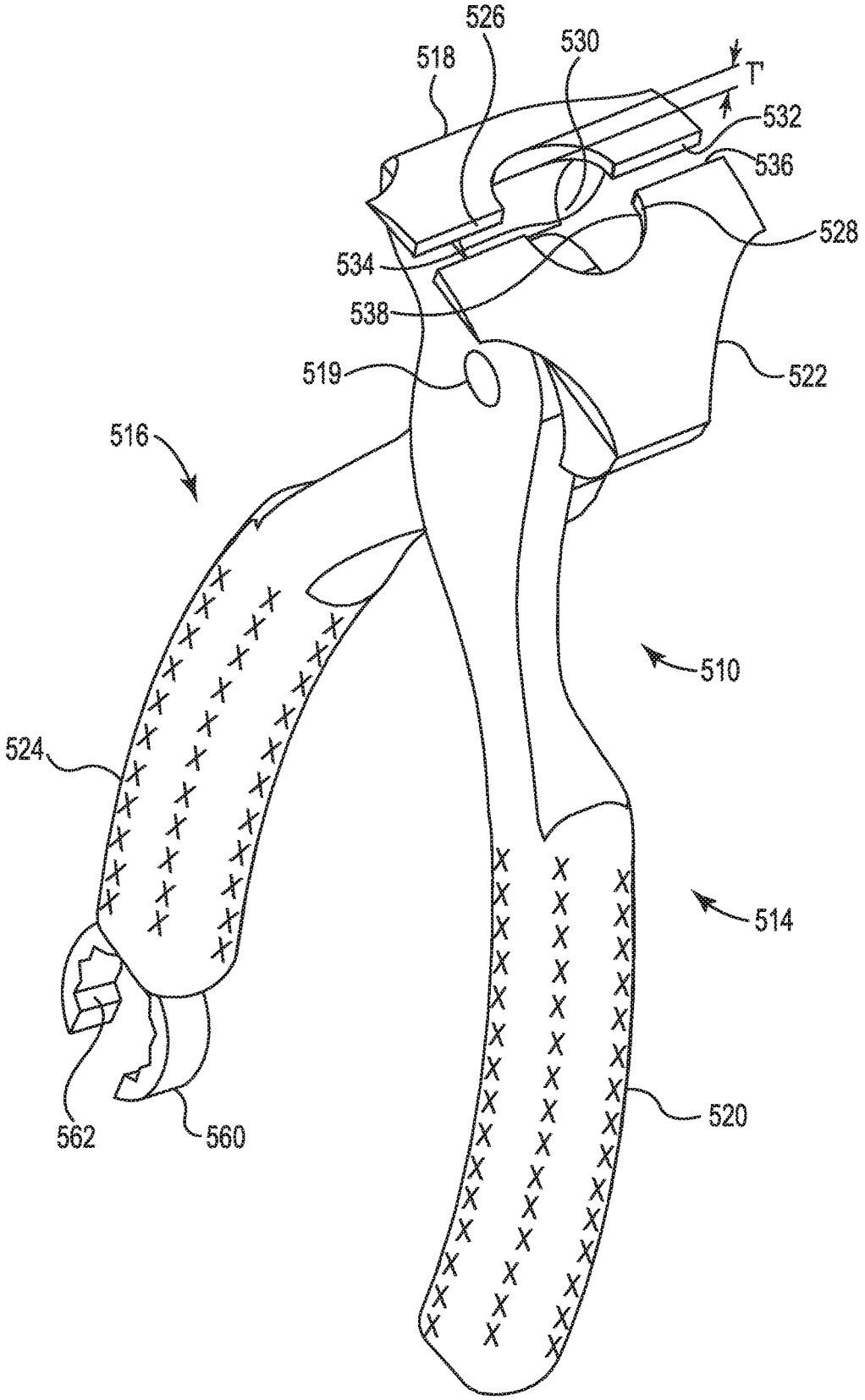
FIG. 8 is a perspective view of another embodiment of the wrench.

FIG. 8 illustrates the configuration of another wrench 510. The wrench 510 has a first member 514 and a second member 516. The first and second members 514, 516 are articulated one another via a coupling member at a pivot axis 519. The first member 514 has a first jaw 518 and a first holding arm 520. The second member 516 has a second jaw 522 and a second holding arm 524. As shown in FIG. 8, a thickness T' of a first or second gripping surface 526, 528 respectively formed on the first and second jaws 518, 522 can be smaller than the thickness T of the first or second gripping surface 26, 28 in the previous embodiment as shown in FIGS. 1-6. In some embodiments, the thickness T' of the first or second nut member contacting wall 534, 538 can range between 0 and 1/15 inches. In another embodiment, the thickness T' of the first or second nut member contacting wall 534, 538 can be 1/15 inches.

In some embodiments, the thickness of the first or second left and right parallel walls 532, 536 can range between 0 and 1/15 inches. In another embodiment, the thickness of the first or second right parallel walls 532, 536 can be 1/15 inches.

In the embodiment illustrated in FIG. 8, the thickness T' of each of the nut member contacting walls 534, 538 decreases from a central portion of the nut member contacting wall 534, 538 toward the respective left and right parallel edges 532, 536. This is different from the previous embodiment as shown in FIGS. 1-6, in which the thickness T of each of the nut member contacting walls 34, 38 increases from a central portion of the nut member contacting wall 34, 38 toward the respective left and right parallel walls 32, 36.

Optionally, the wrench 510 can further include an auxiliary wrench 560 for tightening or loosening nuts. In the depicted embodiment, the auxiliary wrench 560 is a semi-closed wrench having a polygonal inner periphery 562.

Figure 9:
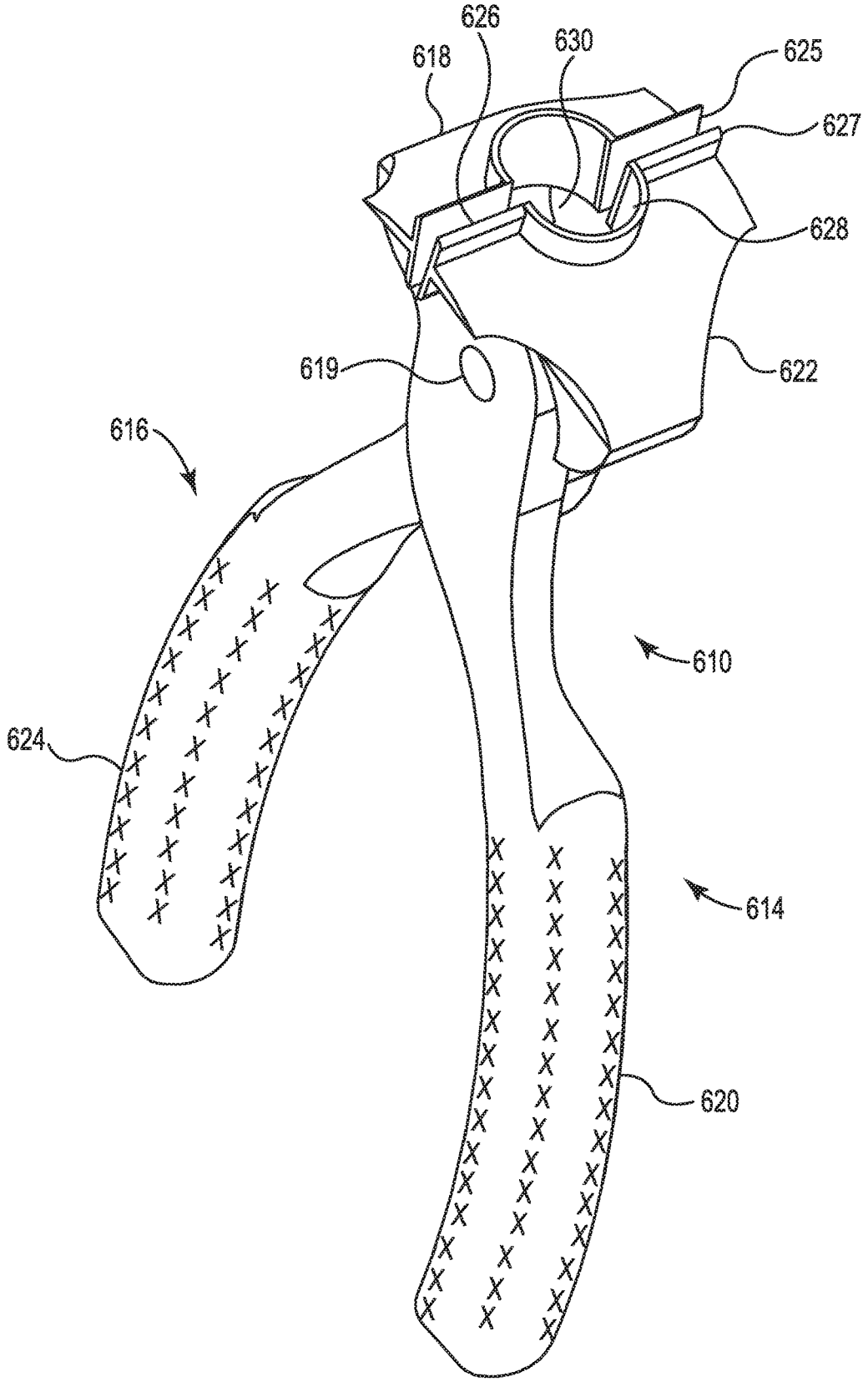
FIG. 9 is a perspective view of a further embodiment of the wrench.

FIG. 9 illustrates the configuration of yet another wrench 610. The wrench 610 has a first member 614 and a second member 616. The first and second members 614, 616 are articulated one another via a coupling member at a pivot axis 619. The first member 614 has a first jaw 618 and a first holding arm 620. The second member 616 has a second jaw 622 and a second holding arm 624. As shown in FIG. 9, the first jaw 618 includes a first flange 625, and the second jaw 622 includes a second flange 627. The flanges 625, 627 help form enlarged gripping surfaces 626, 628, and thus allow a firmer grip on the nut.

Figure 10:
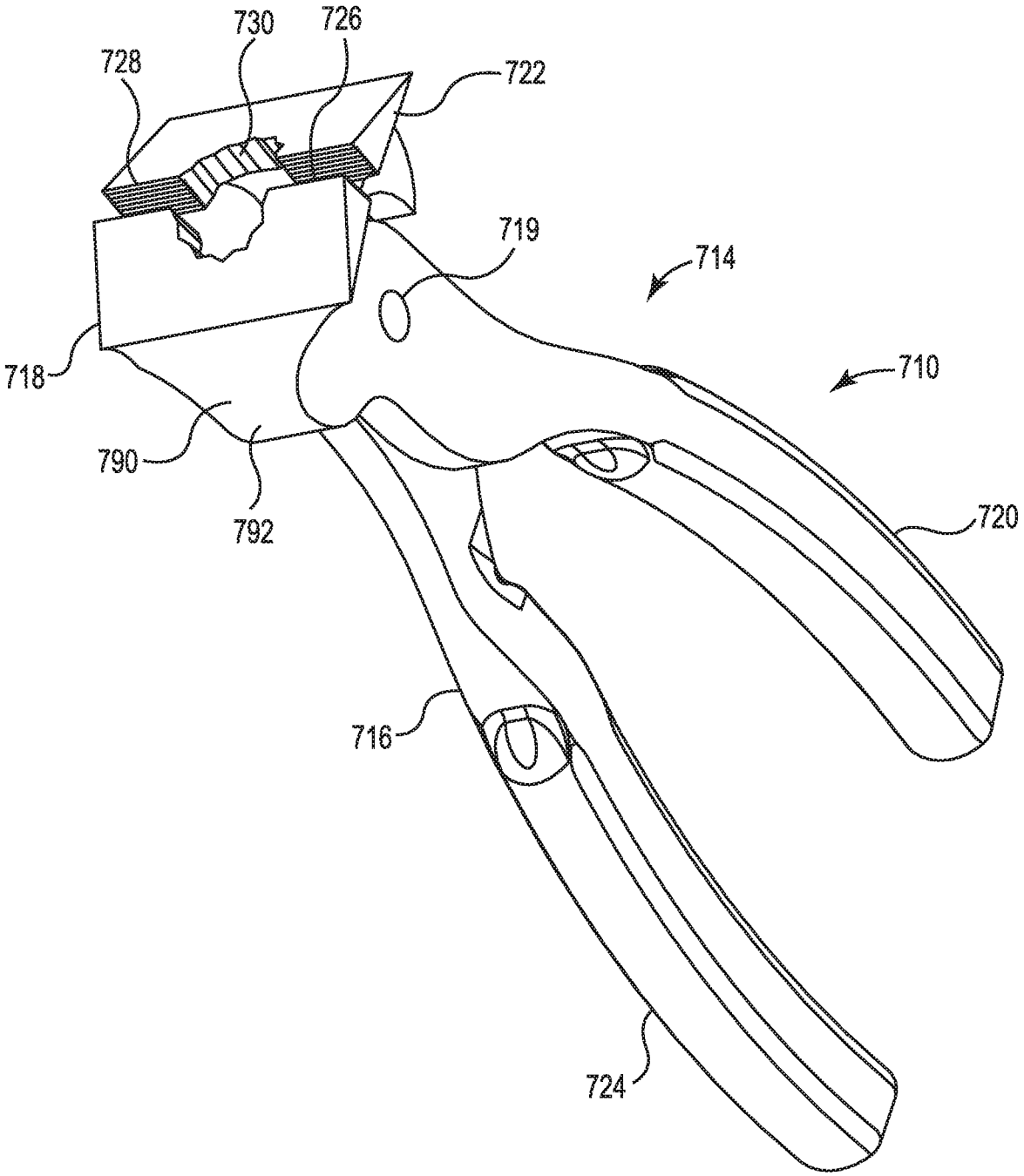
FIG. 10 is a perspective view of a still further embodiment of the wrench.

FIG. 10 illustrates the configuration of yet another wrench 710. The wrench 710 has a first member 714 and a second member 716. The first and second members 714, 716 are articulated one another via a coupling member at a pivot axis 719. The first member 714 has a first jaw 718 and a first holding arm 720. The second member 716 has a second jaw 722 and a second holding arm 724. As shown in FIG. 10, each of the first and second jaws 718, 722 includes a stepped portion 790 formed on a side 792 of the respective jaw 718, 722 opposite the respective gripping surface 726 or 728. In addition, the first and second holding arms 720, 724 are formed with edges for easy fabricating. The wrench 710 further includes an opening 730 which has a plurality of notches, for example, 12 notches. This allows the wrench 710 to be used to securely tighten or loosen a nut without wings.

Figure 11:
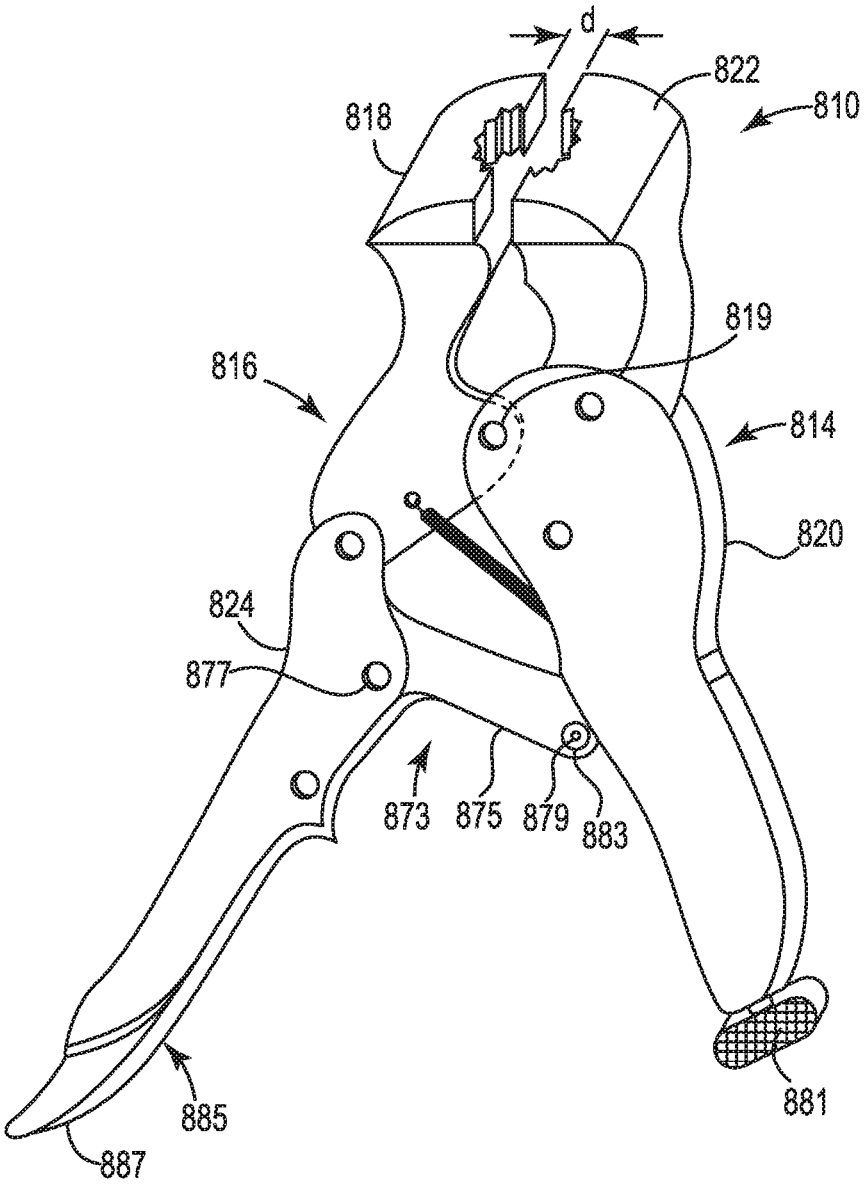
FIG. 11 is a perspective view of a yet further embodiment of the wrench.
Figure 12A:
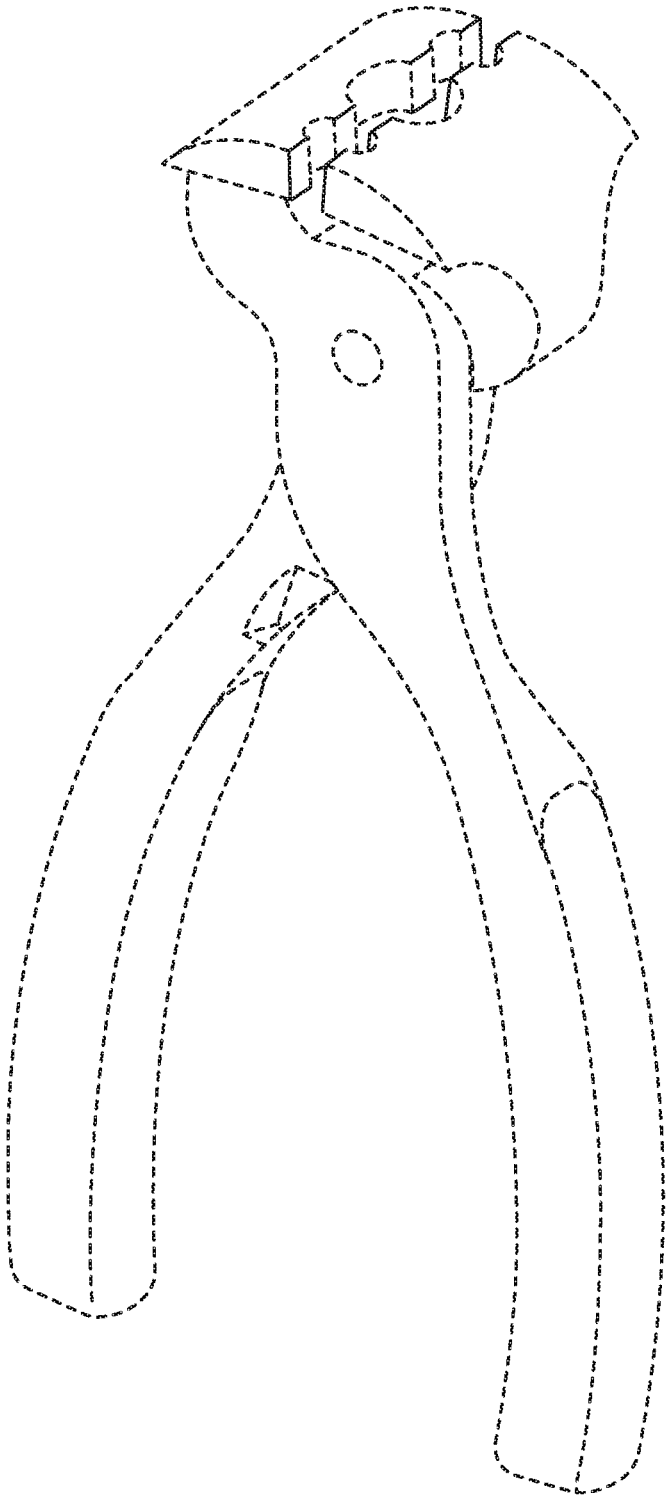
FIG. 12A is a perspective view of another embodiment of the wrench when the first and second jaws are in a closed position with portions of the wrench being disclaimed.
Figure 12B:
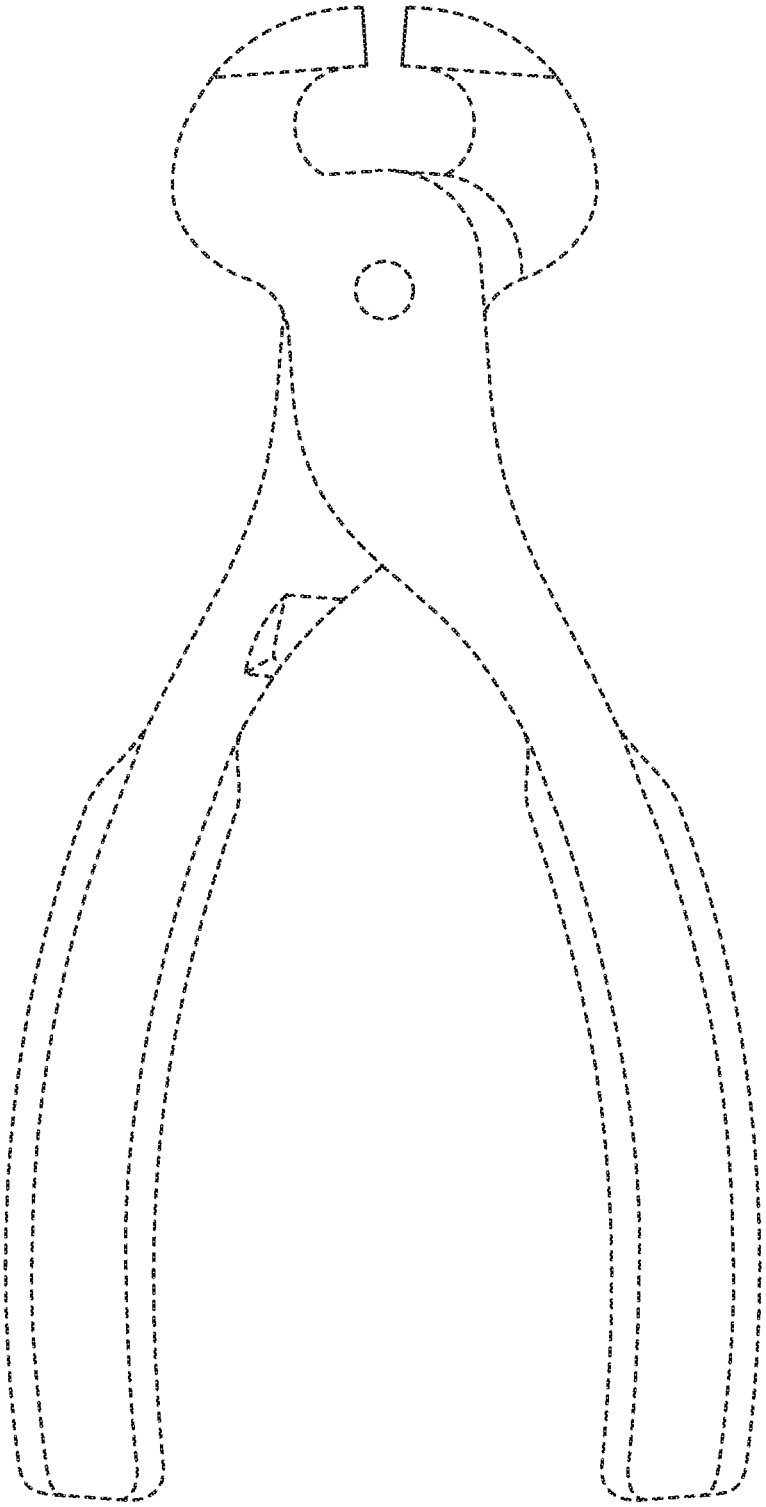
FIG. 12B is a front view of the wrench of FIG. 12A.
Figure 12C:
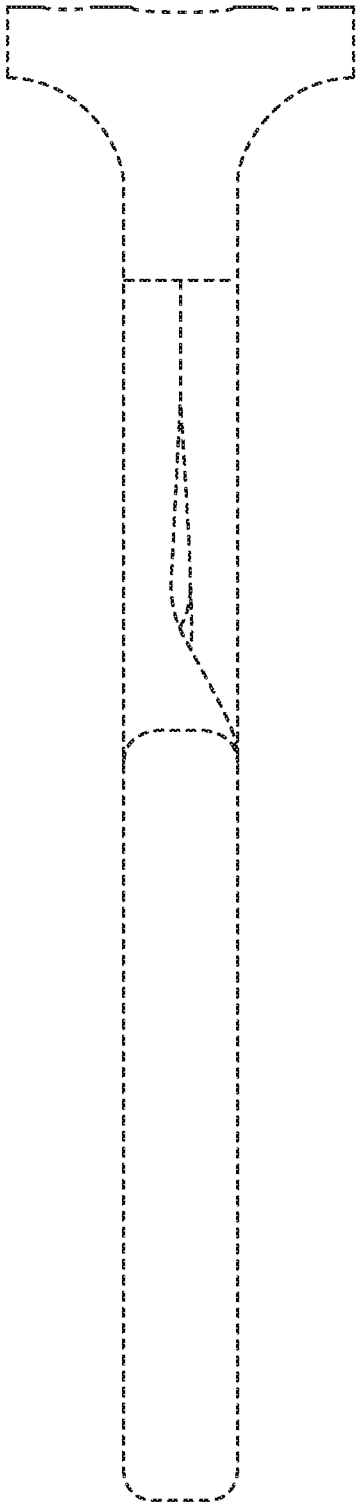
FIG. 12C is a front view of the wrench of FIG. 12A.
Figure 12D:
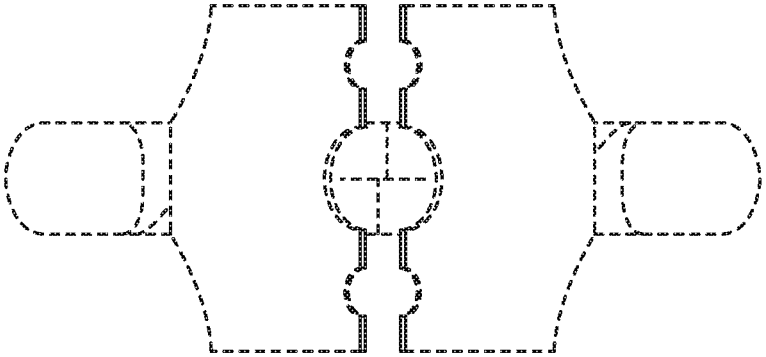
FIG. 12D is a front view of the wrench of FIG. 12A.
Figure 12E:
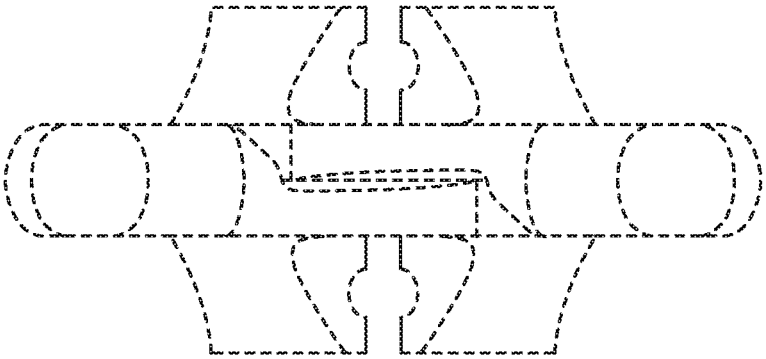
FIG. 12E is a front view of the wrench of FIG. 12A.

FIG. 11 illustrates the configuration of yet another wrench 810. The wrench 810 has a first member 814 and a second member 816. The first and second members 814, 816 are articulated one another via a coupling member at a pivot axis 819. The first member 814 has a first jaw 818 and a first holding arm 820. The second member 816 has a second jaw 822 and a second holding arm 824. As shown in FIG. 11, the wrench 810 has a locking mechanism 873 for locking the wrench 810. It is to be understood that the locking mechanism 873 can take various form. In the embodiment depicted in FIG. 11, when the first and second jaws 818, 822 approach each other until a desired jaw distance d is reached between the first and second jaws 818, 822, or until the first and second jaws 818, 822 purchase on a side surface of the nut 12 and clamp over the nut 12 with desired forces, the locking mechanism 873 can be used to lock the wrench 810. In such circumstances, the first and second jaws 818, 822 are prevented from moving relative to each other and the jaw distance remains constant, even after a plurality of engagements and disengagements of the wrench 810 with the nut 12. The jaw distance will not be changed until the wrench is unlocked.

The locking mechanism 873 includes a link 875 that is pivotably connected between the first and second holding arms 820, 824 to lock the arms and the first and second jaws 818, 822 relative to one another. One end of the link 875 is pivotably connected to the second holding arm 824 at pivot 877. The opposite end of link 875 is pivotably connected to a collar 883 by pivot pin 879. The collar 883 is threadably mounted on a screw 881. The screw 881 is located in the first holding arm 820 such that the longitudinal axis of the screw 881 is disposed along and located in the first holding arm 820. Rotation of the screw 881 moves the collar 883 along the length of the screw 881, i.e., the screw 881 is rotated, the collar 883 is moved in a straight line up and down the length of the screw 881 and the first holding arm 820. The locking mechanism 873 also includes a release lever 885. The release lever 885 is pivotably connected to the second holding arm 824 such that a user may depress the end 887 of lever 885 to move the link 875, thereby unlocking the locking mechanism 873.

The collar 883 moves up and down the length of the first holding arm 820, and as a result the effective length of the locking mechanism is changed to vary the spacing between the first and second jaws 818, 822 in the clamped or locked position. Rotation of adjusting screw 881 changes the distance between pivot 879 and the pivot axis 819. By varying this distance the space between the first and second jaws 818, 822 and the clamping force exerted by the jaws 818, 822 on the nut 12 may be varied and the jaws 818, 822 may be adjusted to grip the nut 12 of varying size with varying force.

It is to be understood that other types of locking mechanism can be used to lock the first and second jaws 818, 822 so that they are not movable relative to each other.

Referring to FIGS. 12A-E, a further embodiment of the wrench is illustrated with portions of the wrench being disclaimed. In this further embodiment, the jaws of the wrench define three openings, including a disclaimed larger opening in the middle, and two disclaimed smaller openings on the left and right sides of the larger opening.

A number of embodiments of the invention have been described. Nevertheless, it will be understood that various modifications may be made without departing from the spirit and scope of the invention.

The invention claimed is:

1. A wrench for tightening or loosening a nut, comprising a first member having a first jaw, a first holding arm and a first joint portion connecting the first jaw to the first holding arm, the first jaw having a first upper surface, a first lower surface, a first nut member contacting wall extending from the first upper surface to the first lower surface, and a first edge defined between the first upper surface and the first nut member contacting wall, the first upper surface being positioned farther away from the first joint portion than the first lower surface;

a second member having a second jaw, a second holding arm and a second joint portion connecting the second jaw to the second holding arm, the second jaw having a second upper surface, a second lower surface, a second nut member contacting wall extending from the second upper surface to the second lower surface, and a second edge defined between the second upper surface and the second nut member contacting wall, the second upper surface being positioned farther away from the second holding arm than the second lower surface;

a joint including the first joint portion, the second joint portion and a pivotal axis at which the first and second members are pivotably coupled to each other, thereby allowing the first and second jaws to be movable between an open position and a closed position; and a first opening defined by the first nut member contacting wall and the second nut member contacting wall, when the first and second jaws are positioned in the closed positions, the first opening having a first central axis extending through a geometric center of the first opening and perpendicular to a plane in which the first opening lies, the first opening having a top edge that comprises the first edge and the second edge, wherein when the first and second holding arms moving away from each other, the first and second jaws move away from the first central axis toward the open position, and when the first and second holding arms moving toward each other, the first and second jaws move toward the first central axis toward the closed position, wherein when the first and second jaws are in the closed position, the first and second holding arms are positioned generally parallel to the first central axis of the first opening, wherein when the first and second jaws engage with a nut being tightened or loosened to rotate the nut, the first holding arm and the second holding arm are positioned generally perpendicular to a rotation plane defined by the top edge of the first opening, wherein the first nut member contacting wall and the second nut member contacting wall are both spaced away from the joint, wherein when the first and second jaws are positioned in the open position, a top surface of the first joint portion and a top surface of the second joint portion generally overlap with each other when viewed from a direction aligned with the pivotal axis, wherein when the first and second jaws are positioned in the closed position, a second opening is formed transverse to the first opening and intersect the first opening, the first and second openings being separated by engaged ends of the first and second jaws, respectively, the second opening having a second central axis positioned generally parallel to the pivot axis, wherein the first jaw further has a first parallel wall extending from an end of the first nut member contacting wall away from the first central axis when the first and second jaws are in the closed position, and the second jaw further has a second parallel wall extending from an end of the second nut member contacting wall away from the first central axis when the first and second jaws are in the closed position, the first and second parallel walls being positioned facing directly toward each and parallel to each other when the first and second jaws are in the closed position, and wherein a thickness of the first nut member contacting wall is greater than a thickness of the first parallel wall, and thickness of the second nut member contacting wall is greater than a thickness of the second parallel wall.

2. The wrench of claim 1, wherein the first jaw has a plurality of first nut member contacting walls, and the second jaw has a plurality of second nut member contacting walls, each of the plurality of the first nut member contacting walls corresponding to one of the plurality of the second nut member contacting walls, the first opening includes a plurality of openings defined by the plurality of first nut member contacting walls and the corresponding plurality of second nut member contacting walls, when the first and second jaws are positioned in the closed positions, each of the plurality of openings has a central axis extending through a geometric center of the respective opening and perpendicular to the plane in which the respective opening lies, the first and second jaws move away from the a plurality of central axes of the plurality of openings when the first and second jaws are moving toward the open position, and the first and second jaws move toward the plurality of central axes of the plurality of openings when the first and second jaws are moving toward the closed position.

3. The wrench of claim 2, wherein the plurality of central axes of the plurality of openings lie in a same axis plane.

4. The wrench of claim 2, wherein the plurality of central axes of the plurality of openings are parallel to each other.

5. The wrench of claim 2, wherein the pivot axis and the plurality of central axes of the plurality of openings lie in a same axis plane.

6. The wrench of claim 2, wherein the shapes of the plurality of openings are selected from the group consisting of circular shapes, oval shapes, parallel elliptical shapes with a major axis generally parallel to the first and second parallel walls, perpendicular elliptical shapes with a major axis generally perpendicular to the first and second parallel walls, diamond shapes, hexagonal shapes, 12-point shapes and 6-point shapes or combination thereof.

7. The wrench of claim 2, wherein the plurality of openings have sizes different from each other.

8. The wrench of claim 2, wherein the pivot axis and the plurality of central axes lie in a same axis plane.

9. The wrench of claim 1, wherein a thickness of the first nut member contacting wall and a thickness of the second nut member contacting wall range between 0 and 2 inches.

10. The wrench of claim 1, wherein the first and second jaws have a generally identical shape and a generally identical size.

11. The wrench of claim 1, further comprising a locking mechanism having a link that is pivotably connected between the first holding arm and the second holding arm that locks the wrench when the first and second jaw purchase on and press a side surface of a nut being tightened or loosened.

12. The wrench of claim 1, wherein when the first and second jaws move between the open and closed positions, a moving direction is generally perpendicular to the first and second parallel walls.

13. The wrench of claim 1, wherein the shape of the first opening is selected from the group consisting of circular shapes, oval shapes, parallel elliptical shapes with a major axis generally parallel to the first and second parallel walls, perpendicular elliptical shapes with a major axis generally perpendicular to the first and second parallel walls, diamond shapes, hexagonal shapes, 12-point shapes and 6-point shapes.

14. The wrench of claim 1, wherein the first and second nut member contacting walls correspond to each other and define the first opening.

15. A method of using the wrench of claim 1, comprising:

approaching a nut from the first central axis direction of the first opening;

clamping on a side wall of the nut by compressing the first and second holding arms toward the first central axis of the wrench and moving the first and second jaws toward the closed position;

rotating the nut clockwise or counterclockwise about the first central axis of the wrench to tighten or loosen the nut; and disengaging the first and second holding arms, so the first and second holding arms are moved away from the first central axis to remove the first and second jaws from the nut.

16. The method claim 15, further comprising:

applying a first force to the nut by the first jaw; and applying a second force to the nut by the second jaw, wherein the first force and the second force are generally equal to each other.

17. A method of using the wrench of claim 1, wherein the nut is a wing nut, the method comprising:

approaching the wing nut from the first central axis direction of the first opening wherein the wing nut having a first and second wings;

clamping on side surfaces of the first and second wings of the wing nut by compressing the first and second holding arms towards the first central axis of the wrench;

rotating the wing nut clockwise or counterclockwise about the first central axis of the wrench to tighten or loosen the wing nut; and disengaging the first and second holding arms, so the first and second holding arms are moved away from the central axis to remove the first and second jaws from the wing nut.

18. A wrench for tightening or loosening a nut, comprising a first member having a first jaw, a first holding arm and a first joint portion connecting the first jaw to the first holding arm, the first jaw having a first upper surface, a first lower surface, a first nut member contacting wall extending from the first upper surface to the first lower surface, and a first edge defined between the first upper surface and the first nut member contacting wall, the first upper surface being positioned farther away from the first joint portion than the first lower surface;

a second member having a second jaw, a second holding arm and a second joint portion connecting the second jaw to the second holding arm, the second jaw having a second upper top surface, a second lower surface, a second nut member contacting wall extending from the second upper surface to the second lower surface, and a second edge defined between the second upper surface and the second nut member contacting wall, the second upper surface being positioned farther away from the second holding arm than the second lower surface;

a joint including the first joint portion, the second joint portion and a pivotal axis at which the first and second members are pivotably coupled to each other, thereby allowing the first and second jaws to be movable between an open position and a closed position; and a first opening defined by the first nut member contacting wall and the second nut member contacting wall, when the first and second jaws are positioned in the closed positions, the first opening having a first central axis extending through a geometric center of the first opening and perpendicular to a plane in which the first opening lies, the first opening having a top edge that comprises the first edge and the second edge, wherein when the first and second holding arms moving away from each other, the first and second jaws move away from the first central axis toward the open position, and when the first and second holding arms moving toward each other, the first and second jaws move toward the first central axis toward the closed position, wherein when the first and second jaws are in the closed position, the first and second holding arms are positioned generally parallel to the first central axis of the first opening, wherein when the first and second jaws engage with a nut being tightened or loosened to rotate the nut, the first holding arm and the second holding arm are positioned generally perpendicular to a rotation plane defined by the top edge of the first opening, wherein the first nut member contacting wall and the second nut member contacting wall are both spaced away from the joint, wherein when the first and second jaws are positioned in the open position, a top surface of the first joint portion and a top surface of the second joint portion generally overlap with each other when viewed from a direction aligned with the pivotal axis, and wherein when the first and second jaws are positioned in the closed position, a second opening is formed transverse to the first opening and intersect the first opening, the first and second openings being separated by engaged ends of the first and second jaws, respectively, the second opening having a second central axis positioned generally parallel to the pivot axis, wherein the first jaw further has a first parallel wall extending from an end of the first nut member contacting wall away from the first central axis when the first and second jaws are in the closed position, and the second jaw further has a second parallel wall extending from an end of the second nut member contacting wall away from the first central axis when the first and second jaws are in the closed position, the first and second parallel walls being positioned facing directly toward each and parallel to each other when the first and second jaws are in the closed position, and wherein at least one of the first and second nut member contacting walls includes a flange enlarging the first and second nut member contacting walls in a direction parallel to the first central axis.

19. A wrench for tightening or loosening a nut, comprising a first member having a first jaw, a first holding arm and a first joint portion connecting the first jaw to the first holding arm, the first jaw having a first upper surface, a first lower surface, a first nut member contacting wall extending from the first upper surface to the first lower surface, and a first edge defined between the first upper surface and the first nut member contacting wall, the first upper surface being positioned farther away from the first joint portion than the first lower surface;

a second member having a second jaw, a second holding arm and a second joint portion connecting the second jaw to the second holding arm, the second jaw having a second upper top surface, a second lower surface, a second nut member contacting wall extending from the second upper surface to the second lower surface, and a second edge defined between the second upper surface and the second nut member contacting wall, the second upper surface being positioned farther away from the second holding arm than the second lower surface;

a joint including the first joint portion, the second joint portion and a pivotal axis at which the first and second members are pivotably coupled to each other, thereby allowing the first and second jaws to be movable between an open position and a closed position; and a first opening defined by the first nut member contacting wall and the second nut member contacting wall, when the first and second jaws are positioned in the closed positions, the first opening having a first central axis extending through a geometric center of the first opening and perpendicular to a plane in which the first opening lies, the first opening having a top edge that comprises the first edge and the second edge, wherein when the first and second holding arms moving away from each other, the first and second jaws move away from the first central axis toward the open position, and when the first and second holding arms moving toward each other, the first and second jaws move toward the first central axis toward the closed position, wherein when the first and second jaws are in the closed position, the first and second holding arms are positioned generally parallel to the first central axis of the first opening, wherein when the first and second jaws engage with a nut being tightened or loosened to rotate the nut, the first holding arm and the second holding arm are positioned generally perpendicular to a rotation plane defined by the top edge of the first opening, wherein the first nut member contacting wall and the second nut member contacting wall are both spaced away from the joint, wherein when the first and second jaws are positioned in the open position, a top surface of the first joint portion and a top surface of the second joint portion generally overlap with each other when viewed from a direction aligned with the pivotal axis, and wherein when the first and second jaws are positioned in the closed position, a second opening is formed transverse to the first opening and intersect the first opening, the first and second openings being separated by engaged ends of the first and second jaws, respectively, the second opening having a second central axis positioned generally parallel to the pivot axis, wherein the first jaw further has a first parallel wall extending from an end of the first nut member contacting wall away from the first central axis when the first and second jaws are in the closed position, and the second jaw further has a second parallel wall extending from an end of the second nut member contacting wall away from the first central axis when the first and second jaws are in the closed position, the first and second parallel walls being positioned facing directly toward each and parallel to each other when the first and second jaws are in the closed position, and wherein at least one of the first and second parallel walls includes a flange enlarging the first and second parallel walls in a direction parallel to the first central axis.

* * * * *